US007779738B2

(12) United States Patent
Pottorff et al.

(10) Patent No.: US 7,779,738 B2
(45) Date of Patent: Aug. 24, 2010

(54) PIVOT PUNCH

(75) Inventors: Earl T. Pottorff, Savannah, NY (US); Robert J. Tewksbury, Seneca Falls, NY (US); Mark J. Clark, Phelps, NY (US)

(73) Assignee: Pearl Technologies Incorporated, Savannah, NY (US)

( * ) Notice: Subject to any disclaimer, the term of this patent is extended or adjusted under 35 U.S.C. 154(b) by 174 days.

(21) Appl. No.: 11/968,408

(22) Filed: Jan. 2, 2008

(65) Prior Publication Data

US 2009/0165620 A1 Jul. 2, 2009

(51) Int. Cl.
*B26F 1/14* (2006.01)

(52) U.S. Cl. ..... 83/684; 83/689; 83/690; 83/698.91

(58) Field of Classification Search ..... 83/314, 83/308, 684, 689, 698.91, 773, 779, 356.2, 83/697, 660, 686, 690, 639.1, 30, 123, 162, 83/284, 588

See application file for complete search history.

(56) References Cited

U.S. PATENT DOCUMENTS 2,676,657 A * 4/1954 Weber et al. ..... 83/302
2,697,489 A * 12/1954 Siegerist ..... 83/320
3,680,616 A * 8/1972 Rejsa ..... 83/26
3,771,403 A * 11/1973 Meyer ..... 83/628
4,462,292 A * 7/1984 Pearl ..... 83/471.2
4,486,929 A * 12/1984 Dickhut et al. ..... 29/33 T
4,753,145 A * 6/1988 Bakermans ..... 83/227
5,035,165 A * 7/1991 Madsen ..... 83/618
6,205,901 B1 * 3/2001 Knutson ..... 83/698.91

* cited by examiner

*Primary Examiner*—Boyer D Ashley
*Assistant Examiner*—Omar Flores-Sánchez
(74) *Attorney, Agent, or Firm*—Bernhard P. Molldrem, Jr.

(57) ABSTRACT

A punch arrangement for punching holes in a moving web of a plastic film has a pivoted yoke mounted on a fixed bracket above the plastic film. An air cylinder or other actuator is mounted on the yoke and has a cutting head mounted on the rod of the cylinder. The cutting head is in registered alignment with an aperture on a support plate below the film. The film engages and swings the cutting head out in the film transport direction until the head rises out of contact with the film. Then a spring urges the yoke, actuator and cutting head back to their home position. A punch cycle can be carried out repeatedly on the film while the film is in constant motion.

7 Claims, 3 Drawing Sheets

PIVOT PUNCH

BACKGROUND OF THE INVENTION

This invention relates to plastic film handling and processing equipment, and is more specifically directed to improved plastic film punch equipment for making holes, openings, and/or slits in one or more layers of a plastic film. The invention is more particularly concerned with an improved punch for plastic film which permits a web of film to move continuously past the punching or cutting station, without intermittent start-stop motion, while holes, openings, and/or slits are being formed in the plastic film material.

The equipment that may be associated with which the punch apparatus of this invention may include a bag machine or similar machine in which where the plastic film is prepared for fabrication into bags, protective sleeves, or other plastic film products.

Punches for bag making machines, in which flexible plastic film is cut and/or in which holes or openings are formed in the film, typically have a pneumatic cylinder or other reciprocating device positioned above an apertured backing plate. The web of plastic film is drawn in one direction so that it moves across the backing plate. The cylinder rod carries a cutting head, which may be steel, brass, or in some cases plastic. The profile of the cutting head is the shape of the hole that is to be formed in the plastic film. When the film reaches the position where the hole is to be punched, the film transport motion is stopped, and the hole is punched by actuating the cylinder. A hold-down clamp descends and holds the film in place on the backing plate. The cylinder pushes the head into the film so that it penetrates the film, and enters into an aperture in the backing plate, to cut the desired opening. Then the head rises back up, the hold-down clamp releases the web of film, and the film moves to the place where the next hole is to be formed. Then the process is repeated. The cut-away circles of plastic film, i.e., "slug", drop into a tube below the apertured backing plate, and can be conducted away, and later recycled or disposed of. Because the cutting head moves strictly vertically, the film has to be stopped momentarily for the cutting operation. If the film were to continue during the time the cutting head has penetrated the plane of the film, then the head would pull the plastic film and would tend to cause undesirable tears and stretches in the film.

The intermittent stopping and starting of the film motion requires additional equipment and controls, and also tends to limit the speed at which the film can be processed in a hole-punching operation. Consequently, the plastic film industry would welcome an effective technique that would form holes in the film, while the film web was in constant motion, but without tearing or stretching the film.

OBJECTS AND SUMMARY OF THE INVENTION

Accordingly, it is an object of this invention to provide an improved reciprocating punch for forming holes, openings, and/or slits in a web of plastic film, and which overcomes the drawbacks of the prior art.

It is more particular object to provide a punch device that can punch holes cleanly in a moving web of film.

It is another object of the invention to provide hole punch for a web of plastic film in which the hold-down mechanism may be omitted.

According to one aspect of the present invention, a pivot punch apparatus is adapted for punching holes in a web of film material as the film moves continuously along a film transport direction. The moving web of film is supported on an apertured backing plate, and a pivot punch or swing punch mechanism is disposed above the backing plate. The punch mechanism has a bracket mounted on a support member, and includes a pivoting yoke member, an air cylinder or other equivalent reciprocating mechanism, and a punch head. The pivoting yoke member has a horizontal pivot member at one end, and the pivot member is journalled onto the bracket at a horizontal pivot axis, which is disposed transverse to the film transport direction. A spring is situated between the yoke member and the bracket. This spring biases the yoke member to a normal (vertical) home position, allowing the yoke member to tilt on the pivot axis, that is, to swing or pivot on that axis. The cylinder or other actuator is mounted onto the yoke member and the punch head is mounted onto the actuator, i.e., carried on the cylinder rod. The actuator holds the punch head in registered alignment with an aperture in the backing plate when said yoke member is in its home position. When the cylinder (actuator) is fired, it reciprocates the punch head to descend vertically, i.e., substantially normal to the backing plate. Also, the aperture in the backing plate is elongated somewhat in the direction of film transport to allow for the swing motion of the punch head.

With a pivot punch that embodies this invention, a punch cycle can be carried out repeatedly on the film while the film is in constant motion. In the punch cycle, the punch head descends vertically to contact and to cut into the film, and also to move into the aperture in the backing plate. The film then engages the cutting head and pulls it in the film transport direction, and pivots the yoke member on the pivot axis. The punch head continues to move in the direction of film transport until the head rises out of contact with the film. At that time, the spring urges the yoke member back to the vertical home position, which brings the actuator and the cutting head back to their home position. Then when the film has reached the position for the next hole, the actuator is fired again, and the cutting cycle is repeated.

The spring is adjustable, that is, the amount of spring force or torque can be adjusted to optimize the cutting operation, depending on the transport speed, film strength, film thickness, size of the hole being cut, and other factors.

In a preferred embodiment the pivot member is situated at a lower end of the yoke member, and the spring is a coil spring situated above the pivot axis, ilel, towards the upper end of the yoke member. However, in other possible embodiments, the yoke could be pivoted at its upper end, or at its center. The spring member is favorably situated between the upper end of the pivoting yoke member and the associated bracket, but could be located elsewhere in some applications.

Favorably, the yoke may be fabricated of a lightweight aluminum alloy to limit its weight for a faster pivoting action. Other materials, e.g., lightweight plastic materials, could be used.

Certain terms of orientation, such as vertical, downward, forward, back, left and right may be used in respect to the embodiment described below. However, it should be appreciated that such terms are used for simplifying the description, and that the principles of this invention would be the same regardless of the positional orientation of the apparatus.

The above and many other objects, features, and advantages of this invention will become apparent from the ensuing description of an exemplary embodiment, which should be read in conjunction with the accompanying Drawing.

DETAILED DESCRIPTION OF THE PREFERRED EMBODIMENTS

Figure 1:
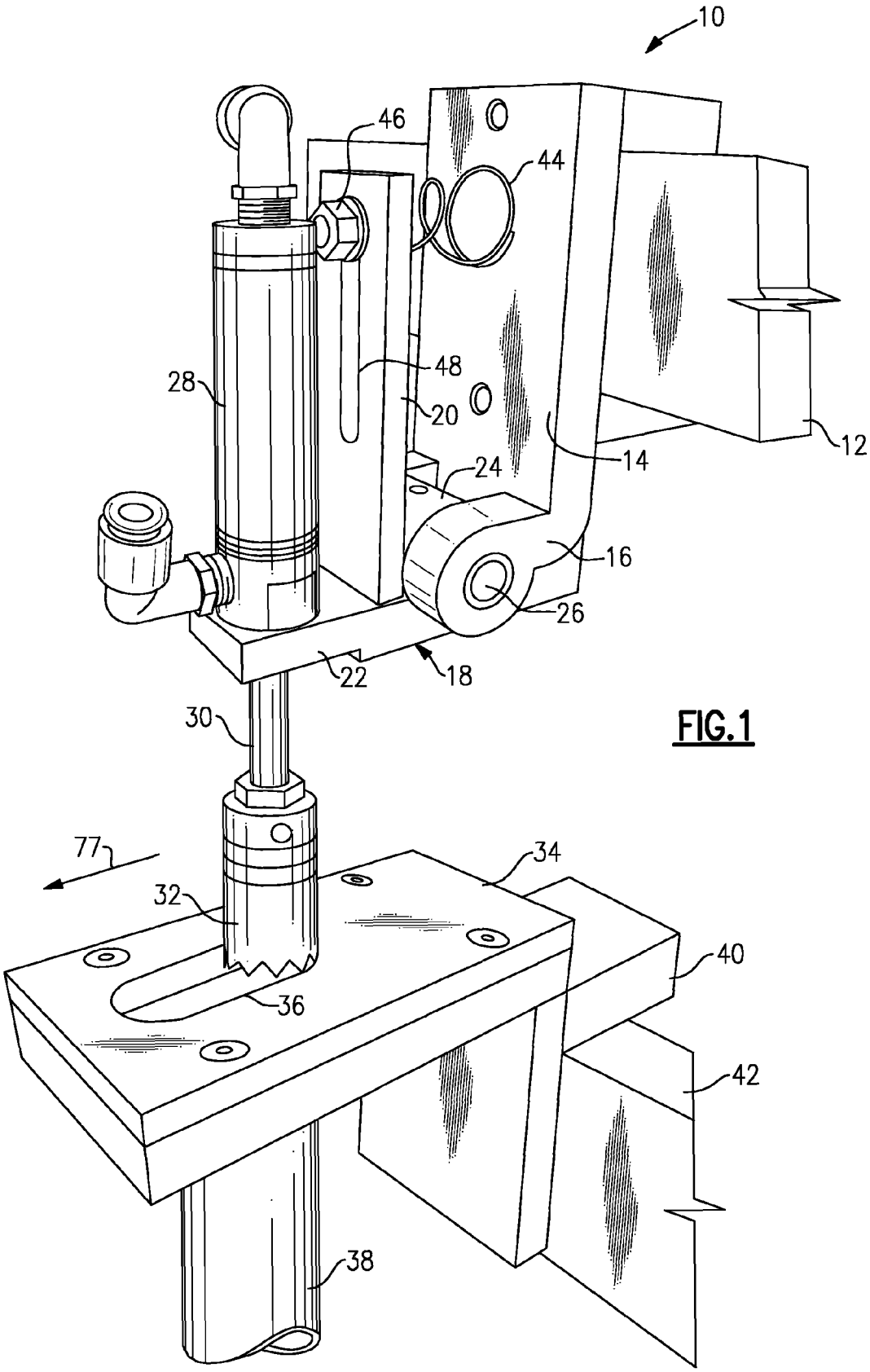
FIG. 1 is a perspective view of a pivot punch arrangement according to one preferred embodiment of the invention.

With reference to the Drawing, FIG. 1 illustrates a pivot punch arrangement that is used for punching holes in a continuously moving web of plastic film.

Above the plane of the film, a bracket 10 is adjustable left-to-right along a transverse support beam 12. The bracket is fixed in position on the beam with bolts or clamps. The bracket 10 has a generally vertical back plate 14 with a horizontal leg, or pair of legs 16 at its lower or base end. Here the legs are disposed one on each side. A pivoting yoke member 18 is mounted pivotally onto the bracket 10. The yoke member 18 has a generally vertical plate 20 (i.e., parallel to the bracket vertical back plate 14), and a base plate 22 at the lower end of the plate 20 oriented generally horizontal. This base plate 22 has a pivot portion 24 formed on it, which is mounted by a pivot pin 26 to the two leg portions 16 of the bracket, so that the yoke member is journalled on the pivot pin 26. The pivot pin 26 is generally horizontal and disposed transversely to the transport direction of the film, which is indicated with an arrow T. Thus, the pivot pin 26 defines a swing axis or pivot axis for the yoke member 18 relative to the bracket 10.

A double-action air cylinder 28 is mounted onto the base plate 24 of the yoke in front of the vertical plate 20. Compressed air is applied via a controller or valve arrangement (not shown) to air inlets at the upper and lower parts of the air cylinder. In some embodiments, a single action air cylinder (e.g., with a spring return) could be employed, or an electric actuator, such as a solenoid could be employed, or in some possible embodiment, a hydraulic actuator.

A rod 30 of the cylinder 28 extends down below the base plate 22, and a cutting head 32 is mounted on the end of the rod. In this example, the cutting head 32 has a round or circular profile for cutting circular holes in the web of film, but other shapes of cutters can be employed, depending on the desired shape of the holes being punched. Also in this embodiment the cutting head 32 is a steel cutter, with crown teeth at its lower end to engage and cut the plastic film. In some cases, other types of cutting heads, e.g., brass, plastic, or other materials may be employed.

Below the plane of the film, an apertured plate 34 is positioned to support the film during the punch cycle and the web of film moves across the upper surface of the plate 34 in the direction of film transport T. The plate has an aperture 36 that is aligned in registry with the position of the punch cutting head 32, when the head is in its home position, i.e., when the yoke is situated in its vertical position, as shown in FIG. 1. The aperture 36 is elongated so that it extends in the film transport direction, to accommodate motion of the cutting head 32 in that direction during a punch cycle. In this embodiment, motion of the head 32 left-to-right, i.e., transverse to the aperture 36, is not permitted.

A slug receptacle tube 38 is positioned below the aperture plate 34, to collect and dispose of the punched-out discs of plastic film that are produced during the punching process. Also shown in FIG. 1 are a mounting bracket 40 for supporting the aperture plate on a lower transverse support rail 42.

Positioned between an upper part of the yoke vertical plate 22 and the vertical back plate 14 of the bracket 10 is a coil spring 44. This incorporates a threaded member so that it can be adjusted in position along a vertical slot 48 in the plate 22, by means of an adjustment nut 46. In some cases, the spring force of the spring 44 can be adjusted in addition to its position above the pivot pin 26. Other embodiments could employ a leaf spring or another resilient member.

The advantage of this pivot type punch arrangement is that it can be fired into the web of film without tearing the film. That is, once the cutting head 32 penetrates the film, the film will pull the head along with it for the amount of time the cylinder rod 30 is extended. The punch can complete one full cycle in about 20 milliseconds. The cutter portion of the punch comprises the cutter 32, cylinder 28, yoke member 18 and upper bracket 10, and the pivot pin 26 forms the pivot axis for swinging or pivoting movement of the punch mechanism. The spring 44 can be adjusted to control how fast the punch yoke member 18 moves back to its home position, i.e., vertical, at the end of the punch cycle.

Figure 2:
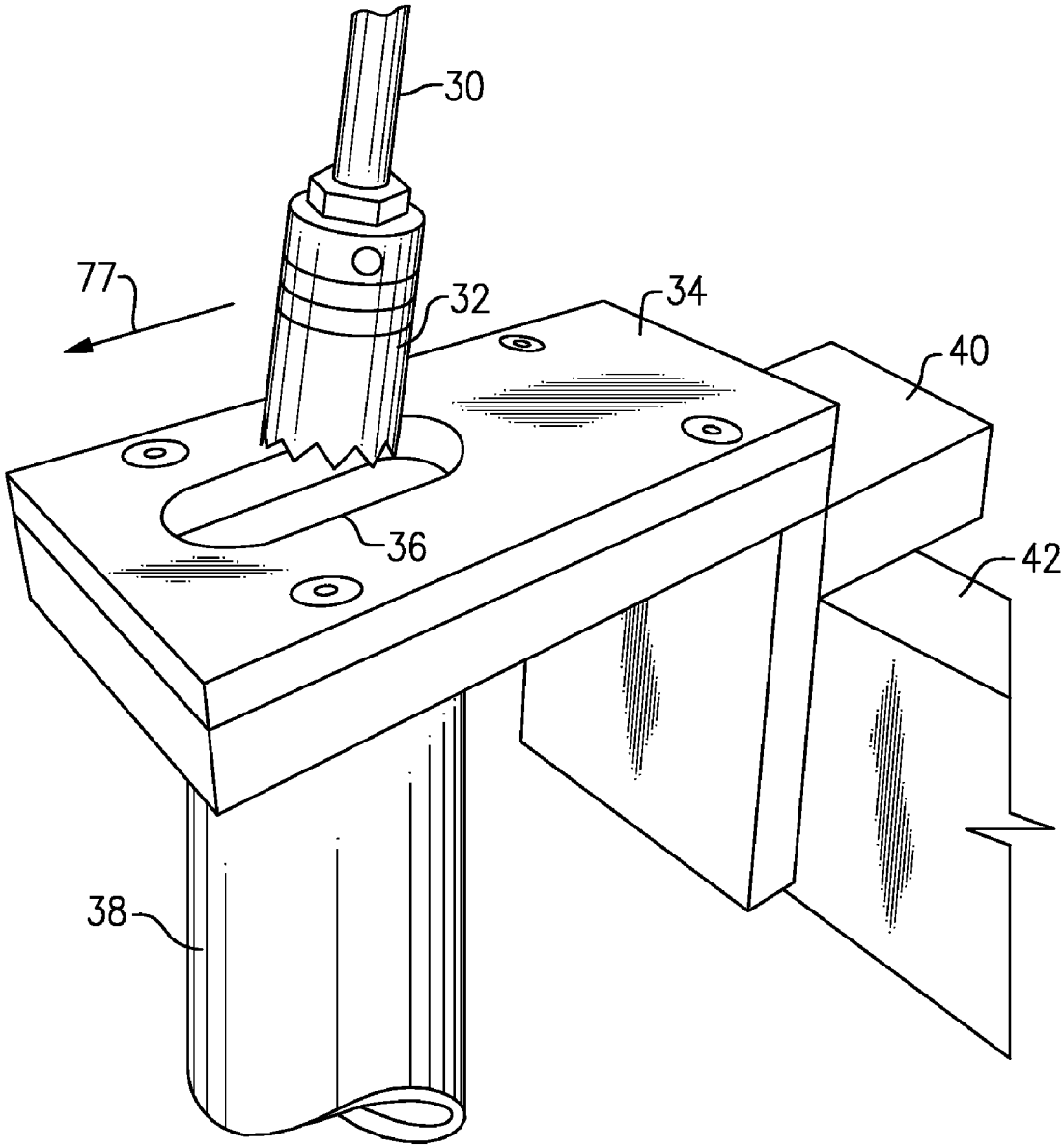
FIG. 2 is a perspective view of the punch cutting head and aperture plate of this embodiment, with the head deflected in the film travel direction.

A punch cycle with this pivot punch arrangement can be explained with reference to FIGS. 2, 3 and 4.

When the punch mechanism is actuated or fired, compressed air is supplied to the upper air inlet of the cylinder 28, extending the rod 30 and driving the head 32 down across the plane of the film, which is moving in the film transport direction T, where the film is supported on the apertured plate 34. The teeth of the head extend into the aperture 36, just below the upper surface of the plate 34. The film continues to move in the direction T. Because the yoke member is pivoted in respect to the fixed bracket 10, the film pulls the cutting head 32 along with it in the direction T, so that the head sweeps out along the elongation direction of the aperture 36, as shown in FIG. 2.

Air is supplied to the lower inlet of the cylinder 28 to withdraw the rod 30 and raise the cutting head 32 out of the plane of the film. The spring 44 urges the plate 20 from its tilted orientation back to the home or vertical position. At this point the punch is ready for the next punch cycle.

Figure 3:
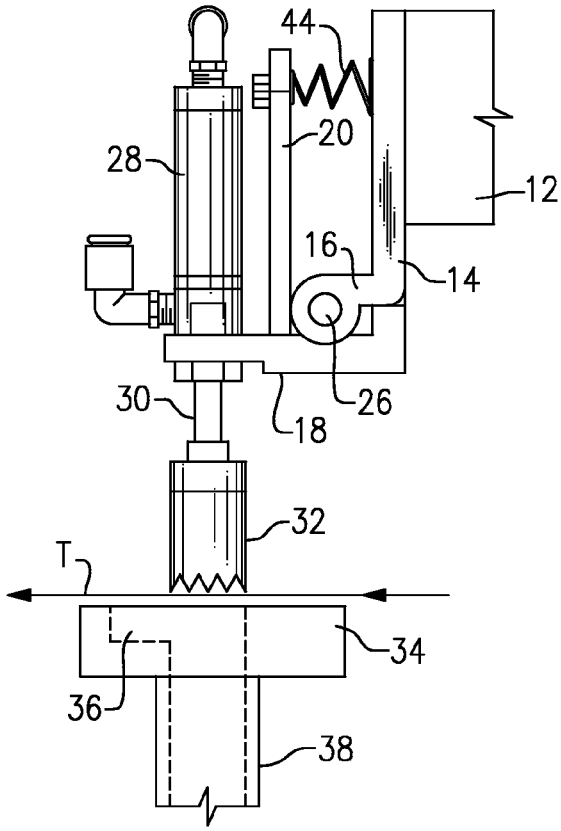
FIGS. 3 and 4 are side elevational views of this embodiment, shown at the beginning of a punch cycle and at the end of the punch cycle, respectively.
Figure 4:
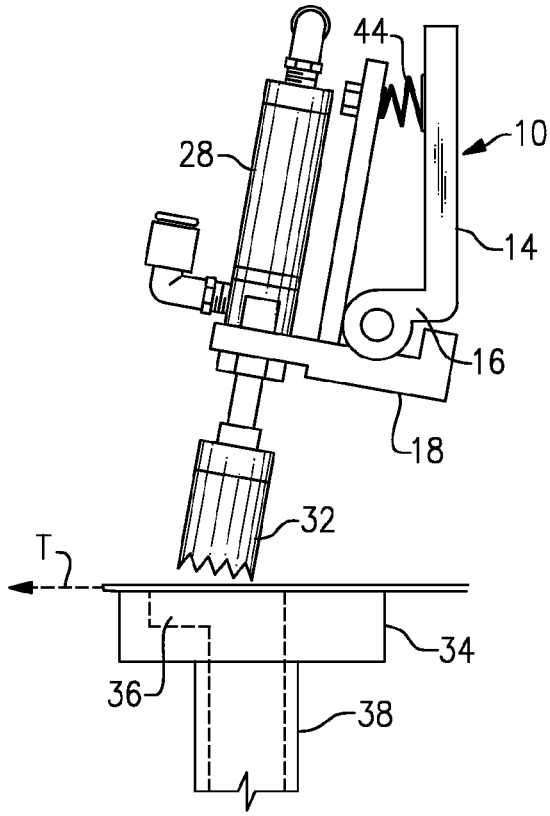

FIGS. 3 and 4 generally show the pivot punch assembly in side elevation. FIG. 3 shows the punch arrangement at the very beginning of the punch cycle, just at the moment when the cylinder 28 is fired, with the yoke member 18 in its home position and the punch head 32 aligned with the back end of the aperture 36. FIG. 4 shows the punch arrangement at the end of the punch cycle, just as the head 32 is being lifted clear of the web of film, with the yoke member 18 rocked over to a tilted position compressing the spring 44. From this position, the punch assembly quickly snaps back to the home position (FIG. 3).

While the invention has been described in respect to a preferred embodiment, it is to be understood that the invention is not limited to that embodiment. Rather, many modifications and variations of this pivot punch are possible according to the principles of this invention, which is to be reckoned in accordance with the accompanying claims.

We claim:

1. A pivot punch apparatus for punching holes in a web of film material that is continuously moving in a film transport direction, the apparatus comprising:

an apertured backing plate on which the moving web of film is supported; and a punch mechanism disposed over said backing plate and including a bracket adapted to be mounted onto a support member;

a pivoting yoke member having a horizontal pivot member at one end thereof, the pivot member being journalled onto said bracket at a horizontal pivot axis transverse to said film transport direction;

a spring disposed on the yoke member above said horizontal pivot axis between said yoke member and said bracket for biasing said yoke member to a vertical home position but allowing the yoke member to tilt on said pivot axis; and an air cylinder actuator mounted on said yoke member above said horizontal pivot axis and having a punch head mounted on a rod thereof and below said horizontal pivot axis, the actuator having a reciprocation axis that is offset from the pivot axis in the film transport direction and holding said punch head in registered alignment with an aperture in said backing plate when said yoke member is in its home position, and said actuator including means for reciprocating said punch head in a direction substantially normal to said backing plate;

so that in a punch cycle the punch head descends vertically to contact and to cut said film and then moves in the direction of film transport until the head rises out of contact with the film, after which the spring urges the yoke member, the actuator, and the cutting head back to the home position.

2. Pivot punch apparatus according to claim 1, wherein aperture in said backing plate is elongated in the film transport direction.

3. Pivot punch apparatus according to claim 1, in which said spring includes means for selectively adjusting the spring force between the yoke member and the bracket.

4. Pivot punch apparatus according to claim 1, in which said spring is a coil spring disposed above said pivot member between said yoke and said back plate.

5. Pivot punch apparatus according to claim 4, including means for adjusting the position of the spring on the yoke member.

6. Pivot punch apparatus according to claim 1, wherein said pivot member is situated at a lower end of said yoke member.

7. Pivot punch apparatus according to claim 6, wherein said spring member is situated between an upper end of said yoke member and said bracket.

* * * * *